US006446715B2

(12) United States Patent
Watanabe et al.

(10) Patent No.: US 6,446,715 B2
(45) Date of Patent: Sep. 10, 2002

(54) FLAT HEAT EXCHANGE TUBES

(75) Inventors: Hirohiko Watanabe; Ryouichi Hoshino; Hiroyasu Simanuki, all of Oyama; Takashi Tamura, Funabashi, all of (JP)

(73) Assignees: Showa Aluminum Corporation, Sakai (JP); Showa Denko K.K., Tokyo (JP)

( * ) Notice: Subject to any disclaimer, the term of this patent is extended or adjusted under 35 U.S.C. 154(b) by 0 days.

(21) Appl. No.: 09/748,015

(22) Filed: Dec. 27, 2000

(30) Foreign Application Priority Data

Dec. 27, 1999 (JP) ..... 11-368723
Jan. 27, 2000 (JP) ..... 2000-018189

(51) Int. Cl.[7] ..... F28F 3/12
(52) U.S. Cl. ..... 165/177; 165/183
(58) Field of Search ..... 165/133, 177, 165/183, 110

(56) References Cited

U.S. PATENT DOCUMENTS 4,470,452 A * 9/1984 Rhodes ..... 165/153
4,627,480 A * 12/1986 Lee ..... 164/369
5,036,909 A * 8/1991 Whitehead et al. ..... 165/133
5,784,776 A * 7/1998 Saito et al. ..... 29/890.046
5,931,226 A * 8/1999 Hirano et al. ..... 165/170
5,947,365 A * 9/1999 Tanaka et al. ..... 228/136

FOREIGN PATENT DOCUMENTS

GB 2159265 A * 11/1985
JP 08121984 A * 5/1996 ..... 165/184
JP 10-328773 12/1998

* cited by examiner

*Primary Examiner*—Allen Flanigan
(74) *Attorney, Agent, or Firm*—Armstrong, Westerman & Hattori, LLP

(57) ABSTRACT

A flat heat exchange tube comprises an upper wall, a lower wall, right and left side walls interconnecting right and left side edges of the upper and lower walls, and a plurality of reinforcing walls connected between the upper and lower walls, extending longitudinally of the tube and spaced apart from one another. The tube has parallel fluid passages formed inside thereof and extending forward or rearward. Each of the reinforcing walls has a plurality of communication holes arranged at a spacing longitudinally thereof for holding the parallel fluid passages in communication with one another therethrough. The upper surface of the lower wall is provided at a portion thereof forming each of the fluid passages with a plurality of turbulence producing portions extending over the entire width of the fluid passage and arranged at a spacing longitudinally of the passage.

13 Claims, 11 Drawing Sheets

FLAT HEAT EXCHANGE TUBES

BACKGROUND OF THE INVENTION

The present invention relates to flat heat exchange tubes for use in heat exchangers such as condensers for car air conditioners and condensers for room air conditioners.

In this specification, the direction of flow of a fluid through the flat heat exchange tube will be referred to as the forward or rearward direction, or longitudinal direction, the widthwise direction of the tube orthogonal to this direction as the leftward or rightward direction, or transverse direction, and the direction of thickness of the tube as the upward or downward direction. Stated with reference to some of the drawings, the upper and lower sides and the left-and right-hand sides of FIGS. 1 and 7 will be referred to as "upper and lower" and "left and right," respectively, the left-hand side of FIGS. 3 and 9 (the upper side of FIGS. 4 to 6 and FIGS. 10 to 13) as "front," and the opposite side thereof as "rear." Further the term "aluminum" as used herein includes aluminum alloys in addition to pure aluminum.

In recent years, widely used in car coolers in place of conventional serpentine condensers are condensers which comprise, as shown in FIG. 14, a pair of headers 70, 71 arranged in parallel and spaced apart from each other, parallel flat heat exchange tubes 72 each joined at its opposite ends to the two headers 70, 71, corrugated aluminum fins 73 arranged in an air flow clearance between the adjacent heat exchange tubes and brazed to the adjacent tubes, an inlet pipe 74 connected to the upper end of peripheral wall of the first 70 of the headers, an outlet pipe 75 connected to the lower end of peripheral wall of the second 71 of the headers, a first partition 76 provided inside the first header 70 and positioned above the midportion thereof, and a second partition 77 provided inside the second header 71 and positioned below the midportion thereof, the number of heat exchange tubes 72 between the inlet pipe 74 and the first partition 76, the number of heat exchange tubes 72 between the first partition 76 and the second partition 77 and the number of heat exchange tubes 72 between the second partition 77 and the outlet pipe 75 decreasing from above downward. A refrigerant flowing into the inlet pipe 74 in a vapor phase flows zigzag through units of passage groups in the condenser before flowing out from the outlet pipe 75 in a liquid phase. The condensers of the construction described (see JP-B No. 45300/1991) are called multiflow condensers, and realize high efficiencies, lower pressure losses and supercompactness.

It is required that the flat heat exchange tube be excellent in heat exchange efficiency and have pressure resistance against the high-pressure gaseous refrigerant to be introduced thereinto. Moreover, the heat exchange tube needs to be small in tubular wall thickness and low in height so as to provide compacted condensers.

Such a flat heat exchange tube is known as disclosed in JP-A No. 328773/1998. This heat exchange tube comprises flat upper and lower walls, right and left side walls interconnecting the right and left side edges of the upper and lower walls, and a plurality of reinforcing walls connected between the upper and lower walls, extending longitudinally of the tube and spaced apart from one another, the tube having parallel fluid passages formed in its interior and extending forward or rearward. The tube is formed from a lower component member of aluminum providing the lower wall, opposite side walls and reinforcing walls, and an upper component member of aluminum providing the upper wall and opposite side walls. A plurality of small projections protruding upward and arranged at a spacing in the longitudinal direction are formed on the upper surface of the lower wall at the portion thereof defining each fluid passage, i.e., at the portion between each pair of adjacent reinforcing walls. The reinforcing wall has a plurality of communication holes arranged at a spacing longitudinally thereof for holding the parallel fluid passages in communication with one another therethrough.

With the condenser comprising such flat heat exchange tubes, communication holes are formed in the reinforcing walls, so that the portions of refrigerant flowing through the respective parallel passages flow transversely of the heat exchange tubes through the communication holes, spreading over all the passages and becoming mixed together to eliminate the likelihood of a temperature difference occurring in the refrigerant between the fluid passages. This results in an improved heat exchange efficiency.

At the location where the refrigerant in the form of a liquid is present conjointly with the refrigerant in the form of a gas, the liquid refrigerant flows so as to form a liquid film over the upper surface portions of the lower wall defining the respective fluid passages, making it less likely that the gaseous refrigerant will come into contact with the upper surface of the lower wall, whereas the projections formed on the lower wall upper surface disturb the flow of the liquid refrigerant, thereby causing the gaseous refrigerant to come into direct contact with the lower wall upper surface to attain an improved heat exchange efficiency.

However, a still higher heat exchange efficiency is required of condensers in recent years, and the condensers comprising conventional heat exchange tubes fail to fully meet this requirement.

SUMMARY OF THE INVENTION

An object of the present invention is to overcome the above problem and to provide a flat heat exchange tube for realizing a heat exchanger which is further improved in heat exchange efficiency.

The present invention provides a flat heat exchange tube which comprises an upper wall, a lower wall, right and left side walls interconnecting right and left side edges of the upper and lower walls, and a plurality of reinforcing walls connected between the upper and lower walls, extending longitudinally of the tube and spaced apart from one another, the tube having parallel fluid passages formed inside thereof and extending forward or rearward, each of the reinforcing walls having a plurality of communication holes arranged at a spacing longitudinally thereof for holding the parallel fluid passages in communication with one another therethrough, an upper surface of the lower wall being provided at a portion thereof forming each of the fluid passages with a plurality of turbulence producing portions extending over the entire width of the fluid passage and arranged at a spacing longitudinally of the passage.

At the location where the refrigerant in the form of a liquid and the refrigerant in the form of a gas are present as mixed together in a condenser comprising such flat heat exchange tubes, the flow of liquid refrigerant forming a liquid film over the upper surface of the lower wall is greatly disturbed by the turbulence producing portions on the upper surface of the lower wall, consequently permitting the gaseous refrigerant to come into contact with the upper surface of the lower wall with greater ease than is the case with the conventional projections. This enables the condenser to achieve a higher heat exchange efficiency than those wherein conventional flat heat exchange tubes are used.

With the flat heat exchange tube according to the present invention, the communication holes in the reinforcing walls are in a staggered arrangement when seen from above, and the turbulence producing portions include those each having one end positioned in corresponding relation with a front end of the communication hole formed in one of the adjacent reinforcing walls and the other end positioned in corresponding relation with a rear end of the communication hole formed in the other reinforcing wall and positioned immediately to the front of the communication hole in said one reinforcing wall, and those each having one end positioned in corresponding relation with a rear end of the communication hole formed in said one reinforcing wall and the other end positioned in corresponding relation with a front end of the communication hole formed in said other reinforcing wall and positioned immediately to the rear of the communication hole in said one reinforcing wall.

In the case of the flat heat exchange tube according to the present invention, the communication holes in the reinforcing walls are in a staggered arrangement when seen from above, and the turbulence producing portions alternatively include those each having one end positioned in corresponding relation with a front end of the communication hole formed in one of the adjacent reinforcing walls and the other end positioned in corresponding relation with a front end of the communication hole formed in the other reinforcing wall and positioned immediately to the rear of the communication hole in said one reinforcing wall, and those each having one end positioned in corresponding relation with a rear end of the communication hole formed in said one reinforcing wall and the other end positioned in corresponding relation with a rear end of the communication hole formed in said other reinforcing wall and positioned immediately to the rear of the communication hole in said one reinforcing wall.

The present invention provides another flat heat exchange tube which comprises an upper wall, a lower wall, right and left side walls interconnecting right and left side edges of the upper and lower walls, and a plurality of reinforcing walls connected between the upper and lower walls, extending longitudinally of the tube and spaced apart from one another, the tube having parallel fluid passages formed inside thereof, an upper surface of the lower wall being provided at a portion thereof forming each of the fluid passages with a plurality of turbulence producing portions extending straight rearward as inclined leftward or rightward and arranged at a spacing longitudinally of the tube.

At the location where the refrigerant in the form of a liquid and the refrigerant in the form of a gas are present as mixed together in a condenser comprising such flat heat exchange tubes, the flow of liquid refrigerant forming a liquid film over the upper surface of the lower wall is greatly disturbed by the turbulence producing portions formed on the upper surface of the lower wall and extending straight rearwardly leftward or rightward, consequently permitting the gaseous refrigerant to come into contact with the lower wall upper surface with greater ease than is the case with the conventional projections. This enables the condenser to achieve a higher heat exchange efficiency than those wherein conventional flat heat exchange tubes are used.

DESCRIPTION OF THE PREFERRED EMBODIMENTS

Figure 1:
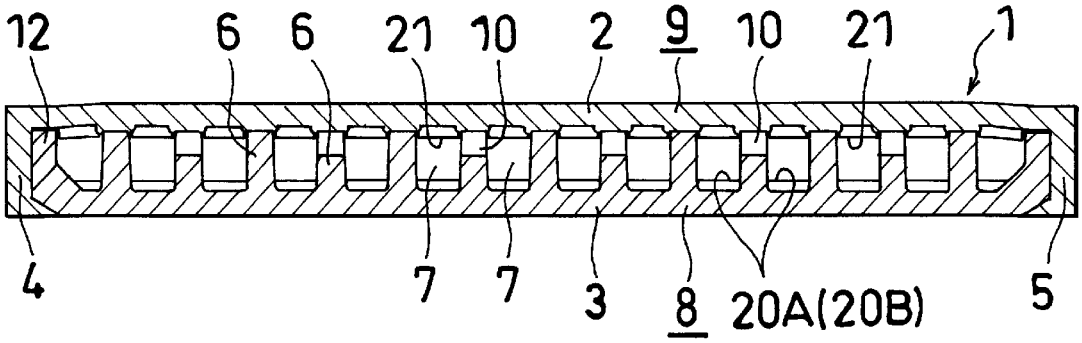
FIG. 1 is a view in cross section of a first embodiment of flat heat exchange tube of the invention.

In the following description, like parts are designated by like reference numerals throughout the drawings.

Figure 2:
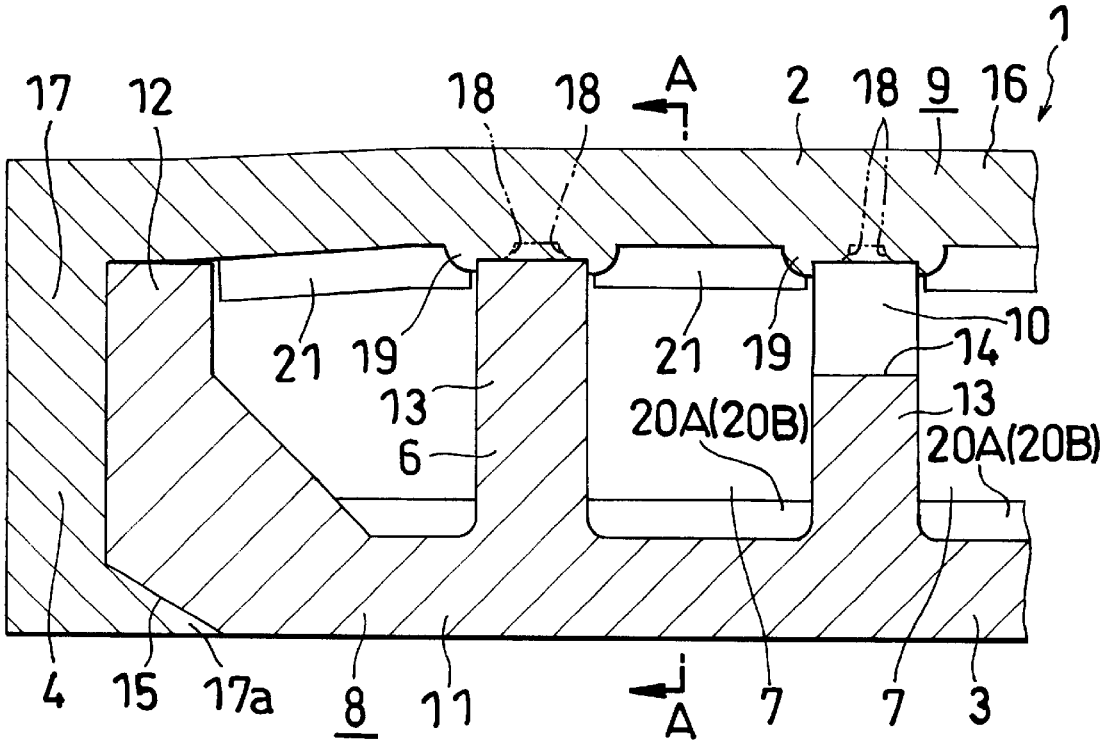
FIG. 2 is an enlarge fragmentary view of FIG. 1.
Figure 3:
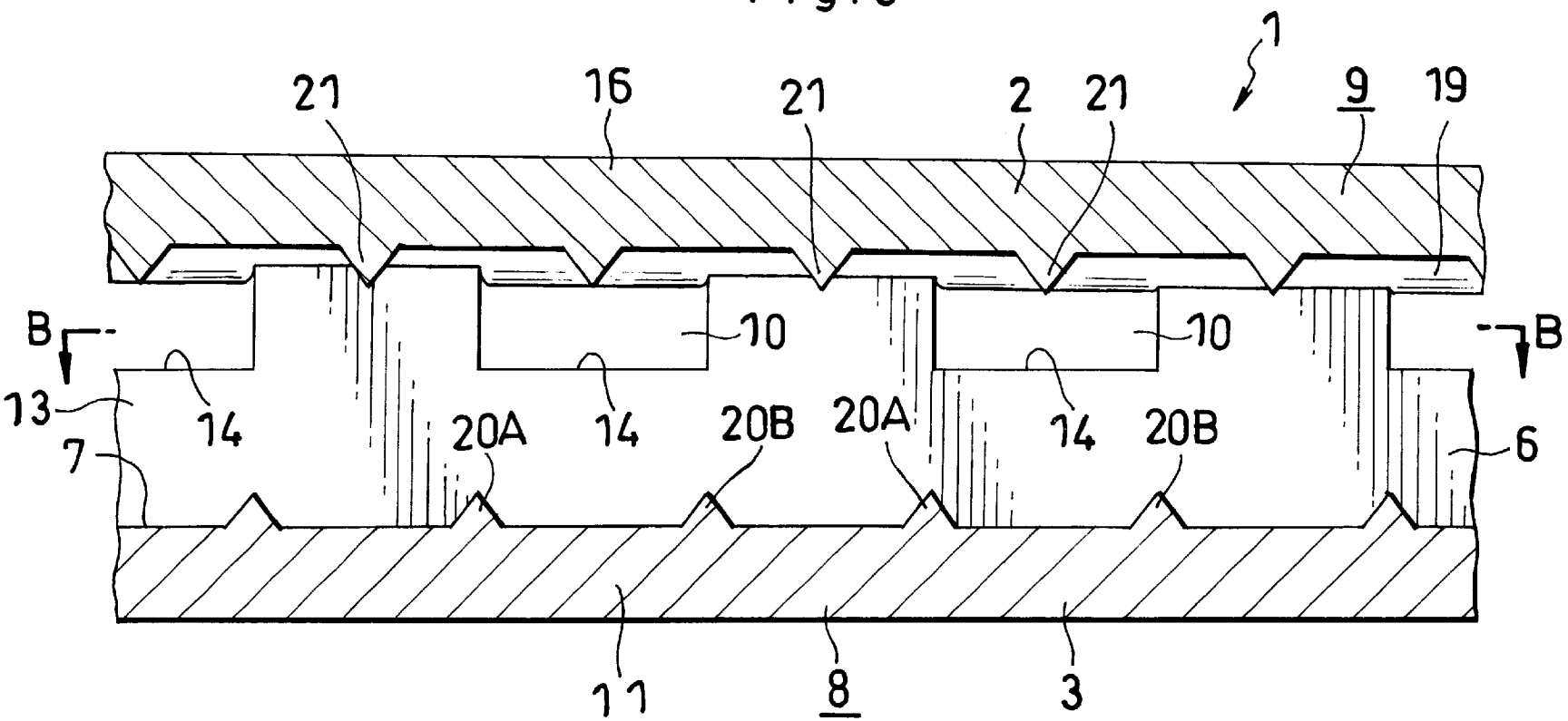
FIG. 3 is a view in section taken along the line A—A in FIG. 2.
Figure 4:
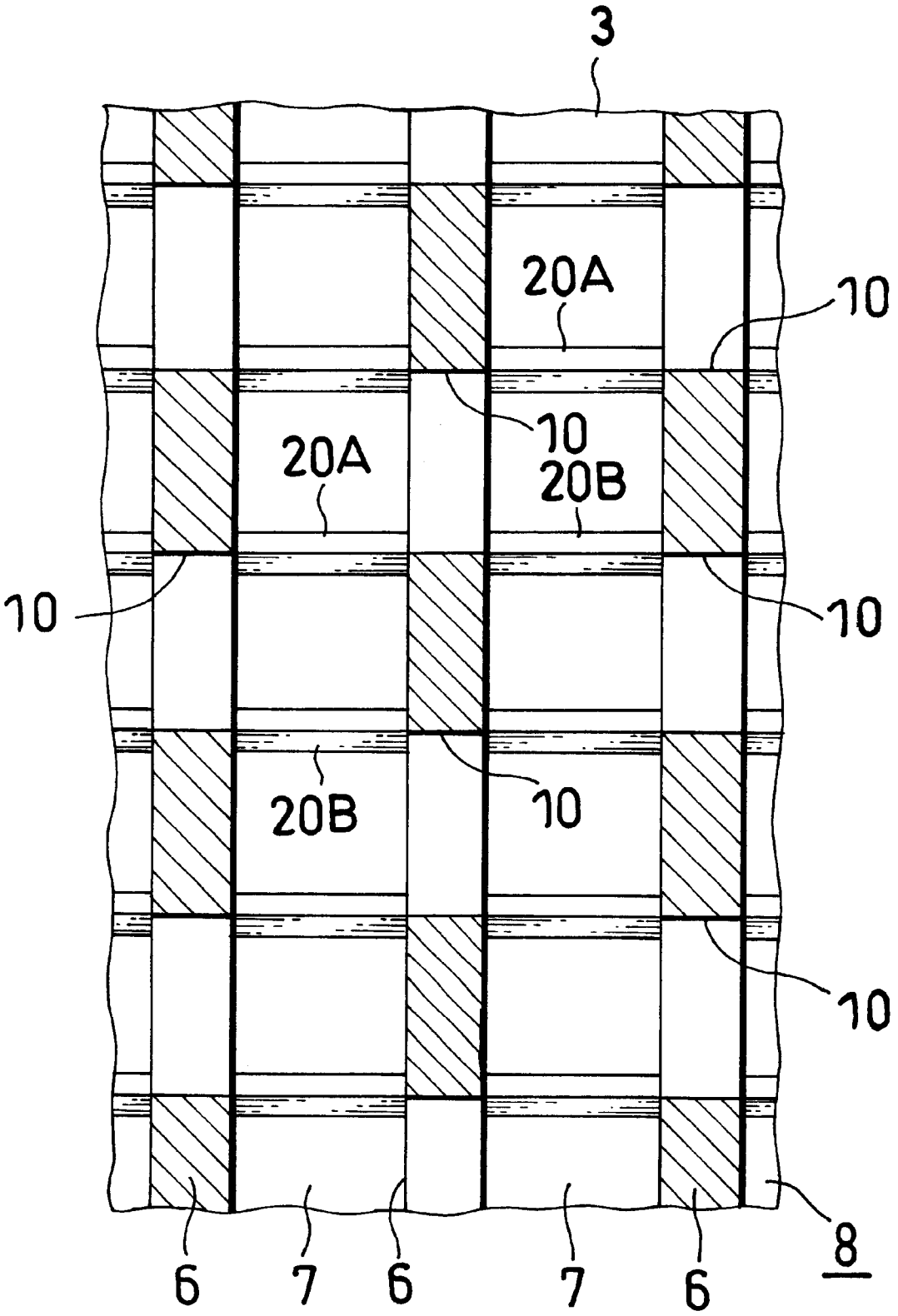
FIG. 4 is a view in section taken along the line B—B in FIG. 3.

FIG. 1 shows the overall construction of a first embodiment of flat heat exchange tube of the invention, and FIGS. 2 to 4 are fragmentary views showing the construction.

With reference to FIG. 1, the flat heat exchange tube 1 comprises flat upper and lower walls 2, 3, left and right side walls 4, 5 interconnecting the left and right side edges of the upper and lower walls 2, 3, and a plurality of reinforcing walls 6 connected between the upper and lower walls 2, 3, extending longitudinally of the tube and spaced apart from one another, the tube having parallel fluid passages 7 formed in its interior and extending forward or rearward. The tube is formed from a lower component member 8 in the form of an aluminum plate and providing the lower wall 3, opposite side walls 4, 5 and reinforcing walls 6, and an upper component member 9 in the form of an aluminum plate and providing the upper wall 2 and opposite side walls 4, 5. The reinforcing wall 6 has a plurality of communication holes 10 arranged at a spacing longitudinally thereof for holding the parallel fluid passages 7 in communication with one another therethrough. All the communication holes 10 are in a staggered arrangement when seen from above.

With reference to FIGS. 2 and 3, the lower component member 8 comprises a lower wall forming portion 11, side wall forming portions 12 protruding upward from the respective opposite side edges of the lower wall forming portion 11 integrally therewith, and reinforcing wall forming portions 13 protruding upward from the lower wall forming portion 11 integrally therewith. A plurality of cutouts 14 are formed in the upper edge of each reinforcing wall forming portion 13 at a spacing longitudinally thereof. The upper ends of the wall forming portions 13 are brazed to the upper wall 2 to close the openings of the cutouts 14 with the upper wall 2, whereby the communication holes 10 are formed.

The lower component member 8 has a slope 15 slanting upward leftwardly or rightwardly outward and formed at each of opposite side edges of its bottom surface.

The upper component member 9 comprises an upper wall forming portion 16, and side wall forming portions 17 extending downward from the respective opposite side edges of the upper wall forming portion 16 integrally therewith. The upper wall forming portion 16 has pairs of left and right ridges 18 formed on its lower surface integrally therewith and extending forward or rearward, the pairs being arranged at a spacing transversely of the tube (see FIG. 2, chain lines).

The lower component member 8 is joined to the upper component member 9 by lapping the side wall forming portions 17 of the upper component member 9 over the respective side wall forming portions 12 of the lower component member 8 from outside, pressing the upper edges of the reinforcing wall forming portions 13 against the respective pairs of ridges 18 on the lower surface of the upper wall forming portion 16 to deform the ridges 18, and bending the lower ends of the side wall forming portions 17 of the upper component member 9 leftwardly or rightwardly inward to provide inward bent parts 17*a* in intimate contact and engagement with the respective slopes 15, whereby the two component members 8, 9 are temporarily held together. In this state, the two side wall forming portions 12, 17 are brazed to each other, the upper edge of each reinforcing wall forming portion 13 is brazed to a single ridge 19 formed by the deformation of each pair of ridges 18, and the inward bent parts 17*a* are brazed to the slopes 15 to fabricate a flat heat exchange tube 1.

As shown in FIG. 4, the upper surface of the lower wall 3 of the flat heat exchange tube 1 is integrally provided with a plurality of turbulence producing portions 20A, 20B on the portion thereof forming each fluid passage 7, the portions 20A, 20B extending straight over the entire width of the passage 7 transversely thereof and being arranged at a spacing longitudinally thereof and each in the form of an upward projection. Stated more specifically, the fluid passage 7 is alternately provided with turbulence producing portions 20A and 20B, each of the portions 20A having a left end positioned in corresponding relation with the front end of the communication hole 10 formed in the left reinforcing wall 6 and a right end positioned in corresponding relation with the rear end of the communication hole 10 formed in the right reinforcing wall 6 and positioned immediately to the front of the hole 10 in the left reinforcing wall 6. Each of the portions 20B has a left end positioned in corresponding relation with the rear end of the communication hole 10 formed in the left reinforcing wall 6 and a right end positioned in corresponding relation with the front end of the communication hole 10 formed in the right reinforcing wall 6 and positioned immediately to the rear of the hole 10 in the left reinforcing wall 6. The turbulence producing portions 20A, 20B have a triangular cross section having an upwardly pointed apex.

The lower surface of the upper wall 2 of the flat heat exchange tube 1 is integrally provided with a plurality of turbulence producing portions 21 on the portion thereof forming each fluid passage 7, the portions 21 extending straight over the entire width of the passage 7 transversely thereof and being arranged at a spacing longitudinally thereof and each in the form of an downward projection (see FIG. 3). When seen from above, the portions 21 have the same shape as the turbulence producing portions 20A, 20B formed on the upper surface of the lower wall 3. The turbulence producing portions 21 are forwardly or rearwardly away from the respective portions 20A, 20B by a distance corresponding to half of the forward or rearward length of the communication holes 10. Stated more specifically, the left end of the portion 21 is positioned at the lengthwise midportion of the communication hole 10 formed in the left reinforcing wall 6 or at the midportion between two longitudinally adjacent communication holes 10 formed therein, and the right end of the portion 21 is positioned at the midportion between two longitudinally adjacent communication holes 10 in the right reinforcing wall 6 or at the lengthwise midportion of the communication hole 10 formed therein. The portion 21 has a triangular cross section pointed downward.

At the location where the refrigerant in the form of a liquid and the refrigerant in the form of a gas are present as mixed together in a condenser comprising such flat heat exchange tubes 1, the flow of liquid refrigerant forming a liquid film over the upper surface of the lower wall 3 is greatly disturbed by the turbulence producing portions 20A, 20B on the upper surface of the lower wall 3, while the flow of liquid refrigerant forming a liquid film over the lower surface of the upper wall 2 is greatly disturbed by the turbulence producing portions 21 on the lower surface of the upper wall 2, consequently permitting the gaseous refrigerant to readily come into contact with the upper surface of the lower wall 3 and the lower surface of the upper wall 2 to thereby achieve an improved heat exchange efficiency.

Figure 5:
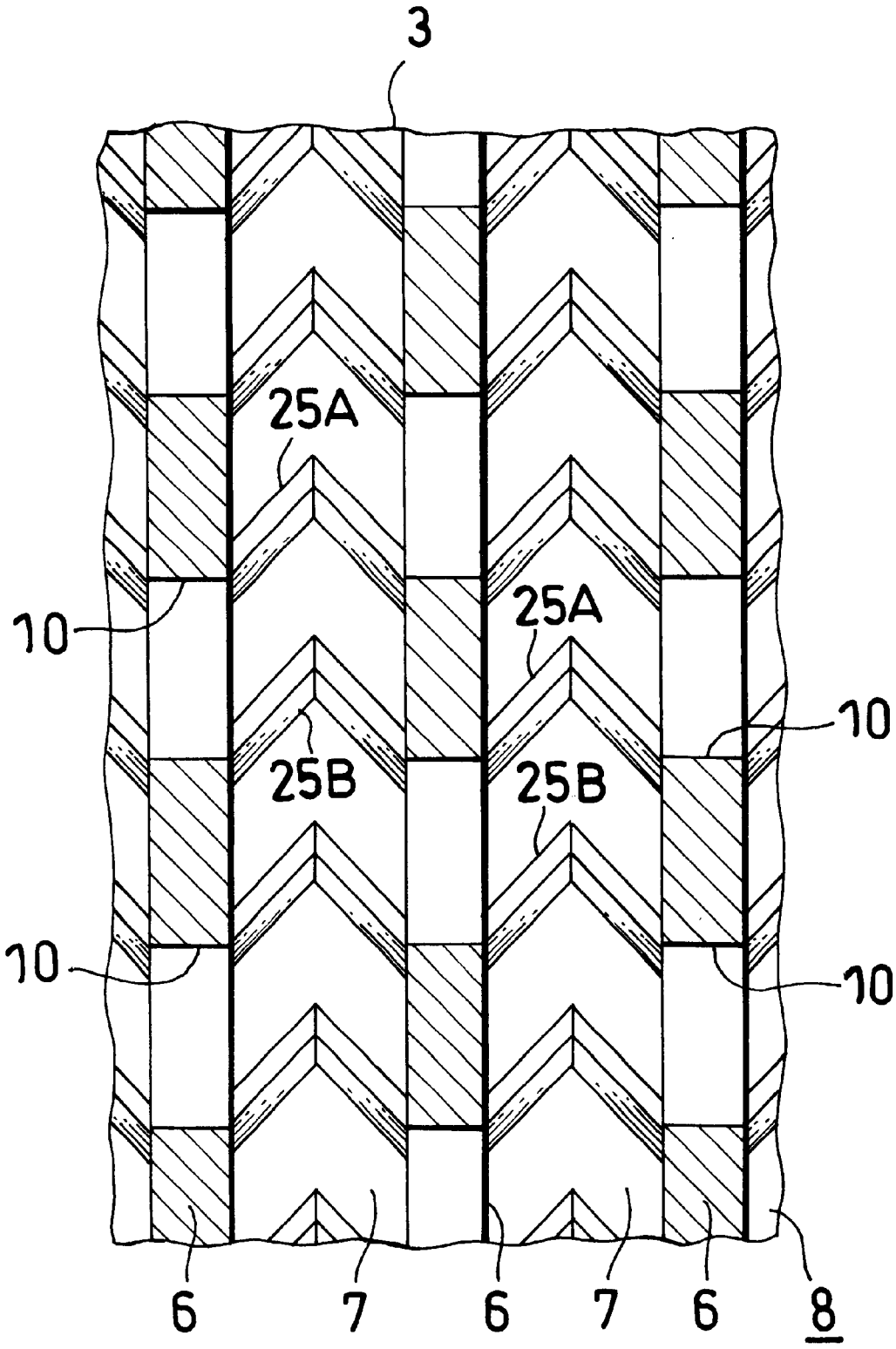
FIG. 5 is a view corresponding to FIG. 4 and showing modified turbulence producing portions according to the first embodiment.

FIG. 5 shows modified turbulence producing portions.

In this case, the upper surface of the lower wall 3 of the flat heat exchange tube is integrally provided with a plurality of turbulence producing portions 25A, 25B on the portion thereof forming each fluid passage 7, the portions 25A, 25B being each V-shaped to extend over the entire width of the passage 7, with the lengthwise midportion thereof projecting forward, and being arranged at a spacing longitudinally of the passage and each in the form of an upward projection. Stated more specifically, the fluid passage 7 is alternately provided with turbulence producing portions 25A and 25B, each of the portions 25A having a left end positioned in corresponding relation with the front end of the communication hole 10 formed in the left reinforcing wall 6 and a right end positioned in corresponding relation with the rear end of the communication hole 10 formed in the right reinforcing wall 6 and positioned immediately to the front of the hole 10 in the left reinforcing wall 6. Each of the portions 25B has a left end positioned in corresponding relation with the rear end of the communication hole 10 formed in the left reinforcing wall 6 and a right end positioned in corresponding relation with the front end of the communication hole 10 formed in the right reinforcing wall 6 and positioned immediately to the rear of the hole 10 in the left reinforcing wall 6. The turbulence producing portions 25A, 25B have a triangular cross section having an upwardly pointed apex.

Although not shown, the lower surface of the upper wall 2 of the flat heat exchange tube is integrally provided with a plurality of turbulence producing portions on the portion thereof forming each fluid passage 7, the portions extending over the entire width of the passage 7 and being arranged at a spacing longitudinally thereof and each in the form of an downward projection. When seen from above, these portions have the same shape as the turbulence producing portions 25A, 25B formed on the upper surface of the lower wall 3. The turbulence producing portions are forwardly or rearwardly away from the respective portions 25A, 25B by a distance corresponding to half of the forward or rearward length of the communication holes 10.

Figure 6:
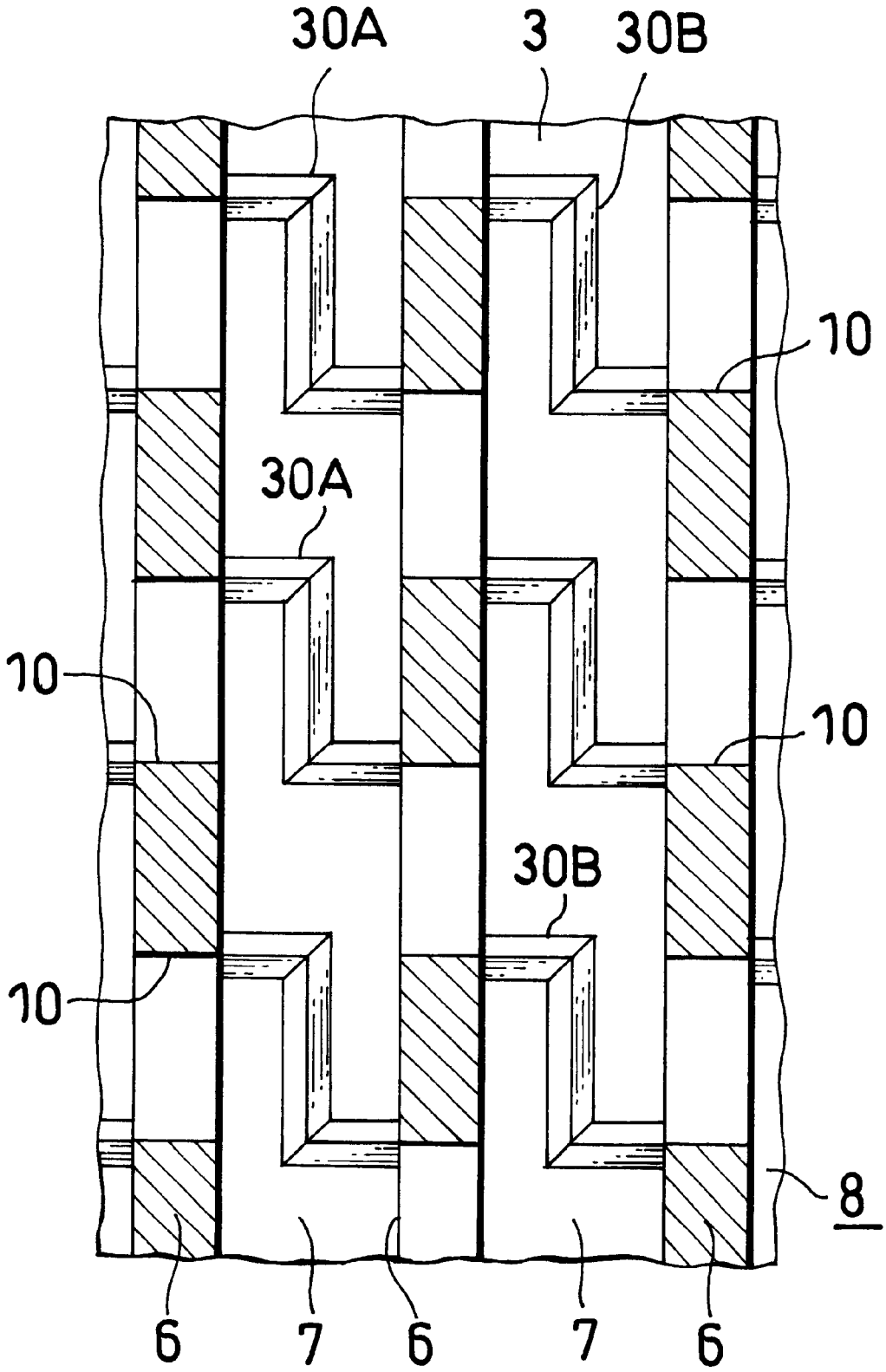
FIG. 6 is a view corresponding to FIG. 4 and showing other modified turbulence producing portions according to the first embodiment.

FIG. 6 shows other modified turbulence producing portions.

In this case, the upper surface of the lower wall 3 of the flat heat exchange tube is integrally provided with a plurality of turbulence producing portions 30A or 30B on the portion thereof forming each fluid passage 7. The portions 30A, 30B are each cranklike when seen from above, arranged at a spacing longitudinally of the passage and each in the form of an upward projection. The turbulence producing portions 30A are formed in one of the adjacent two fluid passages 7, and the turbulence producing portions 30B in the other fluid passage 7. Each of the portions 30A has a left end positioned in corresponding relation with the front end of the communication hole 10 formed in the left reinforcing wall 6 and a right end positioned in corresponding relation with the front end of the communication hole 10 formed in the right reinforcing wall 6 and positioned immediately to the rear of the hole 10 in the left reinforcing wall 6. Each of the other portions 30B has a left end positioned in corresponding relation with the rear end of the communication hole 10 formed in the left reinforcing wall 6 and a right end positioned in corresponding relation with the rear end of the communication hole 10 formed in the right reinforcing wall 6 and positioned immediately to the rear of the hole 10 in the left reinforcing wall 6. The turbulence producing portions 30A, 30B have a triangular cross section with an upwardly pointed apex.

Although not shown, the lower surface of the upper wall 2 of the flat heat exchange tube is integrally provided with a plurality of turbulence producing portions on the portion thereof forming each fluid passage 7, these portions extending over the entire width of the passage 7 and being arranged at a spacing longitudinally thereof and each in the form of an downward projection. When seen from above, these portions have the same shape as the turbulence producing portions 30A, 30B formed on the upper surface of the lower wall 3. The turbulence producing portions are forwardly or rearwardly away from the respective portions 30A or 30B by a distance corresponding to half of the forward or rearward length of the communication holes 10.

FIGS. 7 to 10 show a second embodiment of flat heat exchange tube of the present invention.

Figure 7:
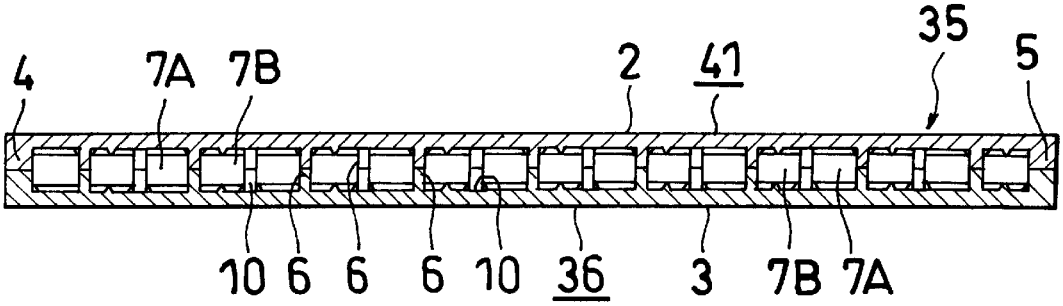
FIG. 7 is a view in cross section of a second embodiment of flat heat exchange tube of the invention.
Figure 8:
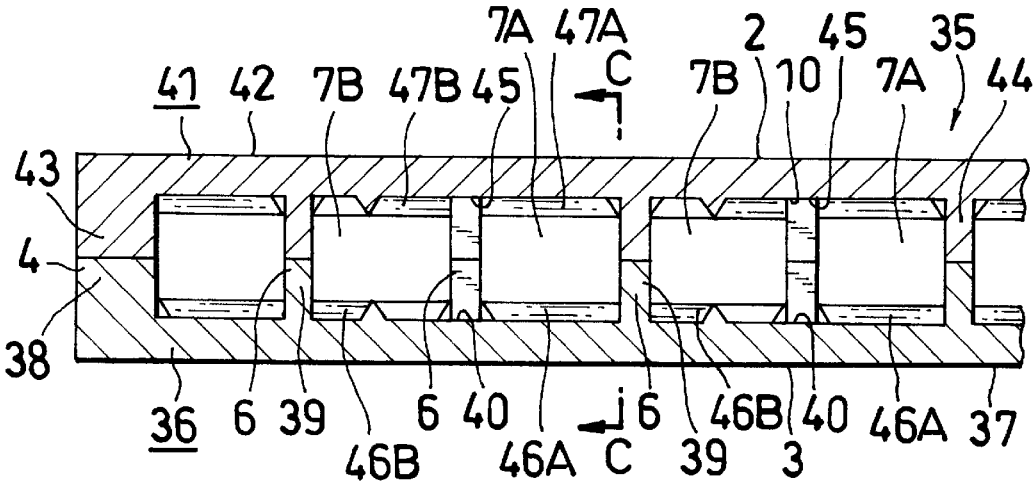
FIG. 8 is an enlarge fragmentary view of FIG. 7.
Figure 9:
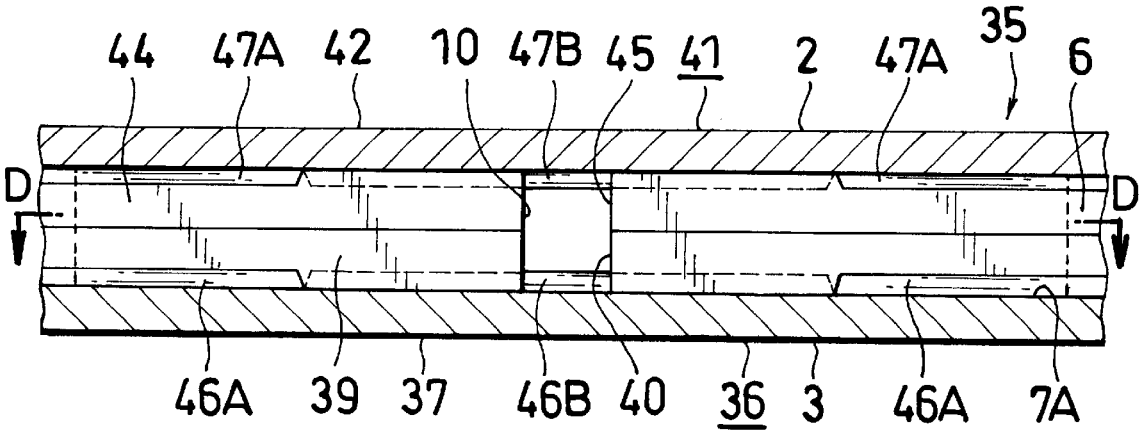
FIG. 9 is a view in section taken along the line C—C in FIG. 8.

With reference to FIGS. 7 to 9 showing this embodiment, a lower component member 36 in the form of an aluminum plate and constituting a flat heat exchange tube 35 comprises a flat lower wall forming portion 37, side wall forming portion 38 protruding upward from the respective left and right side edges of the portion 37 integrally therewith and extending longitudinally of the tube 35, and a plurality of reinforcing wall forming portions 39 upwardly projecting from the lower wall forming portion 37 integrally therewith, spaced apart from one anther transversely thereof as positioned between the side wall forming portions 38 and extending longitudinally of the tube. The side wall forming portions 38 and the reinforcing wall forming portions 39 have the same height. The reinforcing wall forming portions 39 have cutouts 40 formed over the entire height thereof and positioned in a staggered arrangement. An upper component member 41 in the form of an aluminum plate comprises a flat upper wall forming portion 42, side wall forming portions 43 projecting downward from the respective left and right side edges of the portion 42 integrally therewith and extending longitudinally of the tube 35, and a plurality of reinforcing wall forming portions 44 downwardly projecting from the upper wall forming portion 42 integrally therewith, spaced apart from one anther transversely thereof as positioned between the side wall forming portions 43 and extending longitudinally of the tube. The side wall forming portions 43 and the reinforcing wall forming portions 44 have the same height. The reinforcing wall forming portions 44 have cutouts 45 formed over the entire height thereof and positioned in a staggered arrangement. The side wall forming portions 38 of the lower component member 36 are joined to the respective side wall forming portions 43 of the upper component member 41 other end-to-end, and the reinforcing wall forming portions 39 of the lower component member 36 are similarly joined to the respective reinforcing wall forming portions 44 of the upper component member 41, whereby a flat heat exchange tube is fabricated. The cutouts 40 in the lower component member 36 and the cutouts 45 in the upper component member 41 form communication holes 10.

Figure 10:
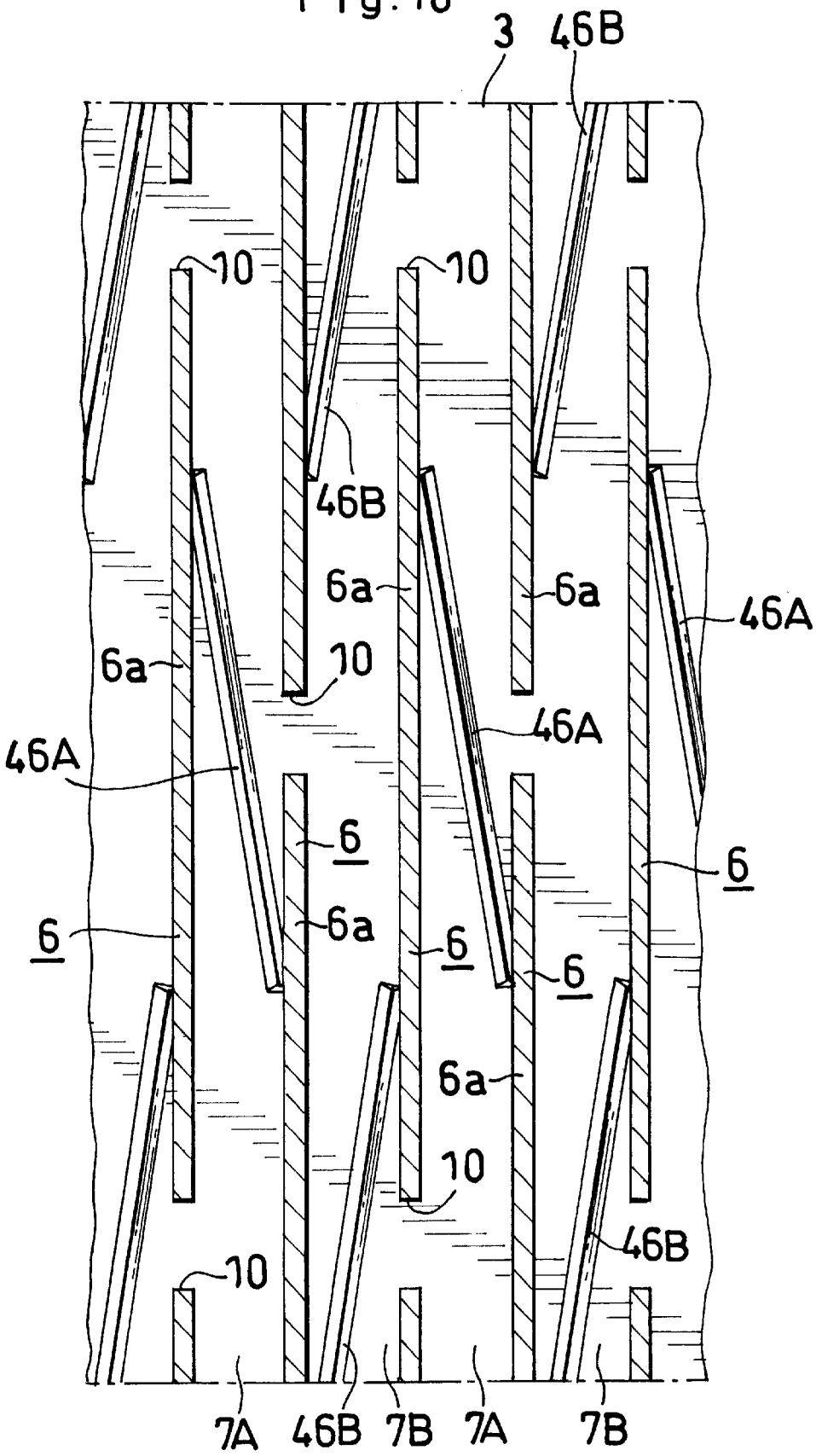
FIG. 10 is a view in section taken along the line D—D in FIG. 9.

With reference to FIG. 10, the upper surface of the lower wall 3 of the flat heat exchange tube 35 is integrally provided with a plurality of turbulence producing portions 46A on the portion thereof forming one fluid passage 7A, the portions 46A extending straight as inclined rearwardly rightward over the entire width of the passage 7A and being arranged at a spacing longitudinally thereof and each in the form of an upward projection. The lower wall upper surface is further integrally provided with a plurality of turbulence producing portions 46B on the portion thereof forming a fluid passage 7B adjacent to the passage 7A. The portions 46B extend straight as inclined rearwardly leftward over the entire width of the passage 7B and are each in the form of an upward projection and arranged at a spacing longitudinally of the passage. Stated more specifically, the fluid passage 7A has turbulence producing portions 46A extending straight as inclined rearwardly rightward and each having a front end joined to the portion 6*a* of the left reinforcing wall 6 between longitudinally adjacent two communication holes 10 at a position closer to the front end of this portion 6*a* and a rear end joined to the portion 6*a* of the right reinforcing wall 6 between longitudinally adjacent two communication holes 10 at a position closer to the front end of this portion 6*a*. The communication hole 10 in the right reinforcing wall 6 defining the fluid passage 7A is positioned at the midportion of length of the turbulence producing portion 46A. The fluid passage 7B adjacent to the passage 7A has turbulence producing portions 46B extending straight as inclined rearwardly leftward and each having a front end joined to the portion 6*a* of the right reinforcing wall 6 between longitudinally adjacent two communication holes 10 at a position closer to the rear end of this portion 6*a* and a rear end joined to the portion 6*a* of the left reinforcing wall 6 between longitudinally adjacent two communication holes 10 at a position closer to the rear end of this portion 6*a*. The communication hole 10 in the right reinforcing wall 6 defining the fluid passage 7B is positioned at the midportion of length of the turbulence producing portion 46B. All the turbulence producing portions 46A, 46B are in a staggered arrangement when seen from above. All of these portions 46A, 46B have a triangular cross section with an upwardly pointed apex.

The lower surface of the upper wall 2 of the flat heat exchange tube 35 is integrally provided with a plurality of turbulence producing portions 47A (47B) on the portion thereof forming each fluid passage 7A (7B). The portions 47A (47B) extend over the entire width of the fluid passage 7A (7B), and are each in the form of a downward projection, joined at their opposite ends to the reinforcing walls 6 defining the passage and arranged at a spacing longitudinally thereof. The turbulence producing portions 47A (47B) formed on the upper wall lower surface forming the fluid passage 7A (7B) are arranged in the same positions as the turbulence producing portions 46A (46B) formed on the lower wall upper surface in the same passage 7A (7B) with respect to the longitudinal direction but are inclined in the opposite direction to the portions 46A (46B) as they extend rearward.

The fluid passage defined by each of opposite side walls 4 and the reinforcing wall 6 adjacent thereto is provided, on the upper surface of the lower wall 3 and the lower surface of the upper wall 2, with the same turbulence producing portions as in the fluid passage 7A or 7B which is the third as counted from the above-mentioned side fluid passage.

At the location where the refrigerant in the form of a liquid and the refrigerant in the form of a gas are present as mixed together in a condenser comprising such flat heat exchange tubes 35, the flow of liquid refrigerant forming a liquid film over the upper surface of the lower wall 3 is greatly disturbed by the turbulence producing portions 46A, 46B on the upper surface of the lower wall 3, while the flow of liquid refrigerant forming a liquid film over the lower surface of the upper wall 2 is greatly disturbed by the turbulence producing portions 47A, 47B on the lower surface of the upper wall 2, consequently permitting the gaseous refrigerant to readily come into contact with the upper surface of the lower wall 3 and the lower surface of the upper wall 2 to thereby achieve an improved heat exchange efficiency.

Figure 11:
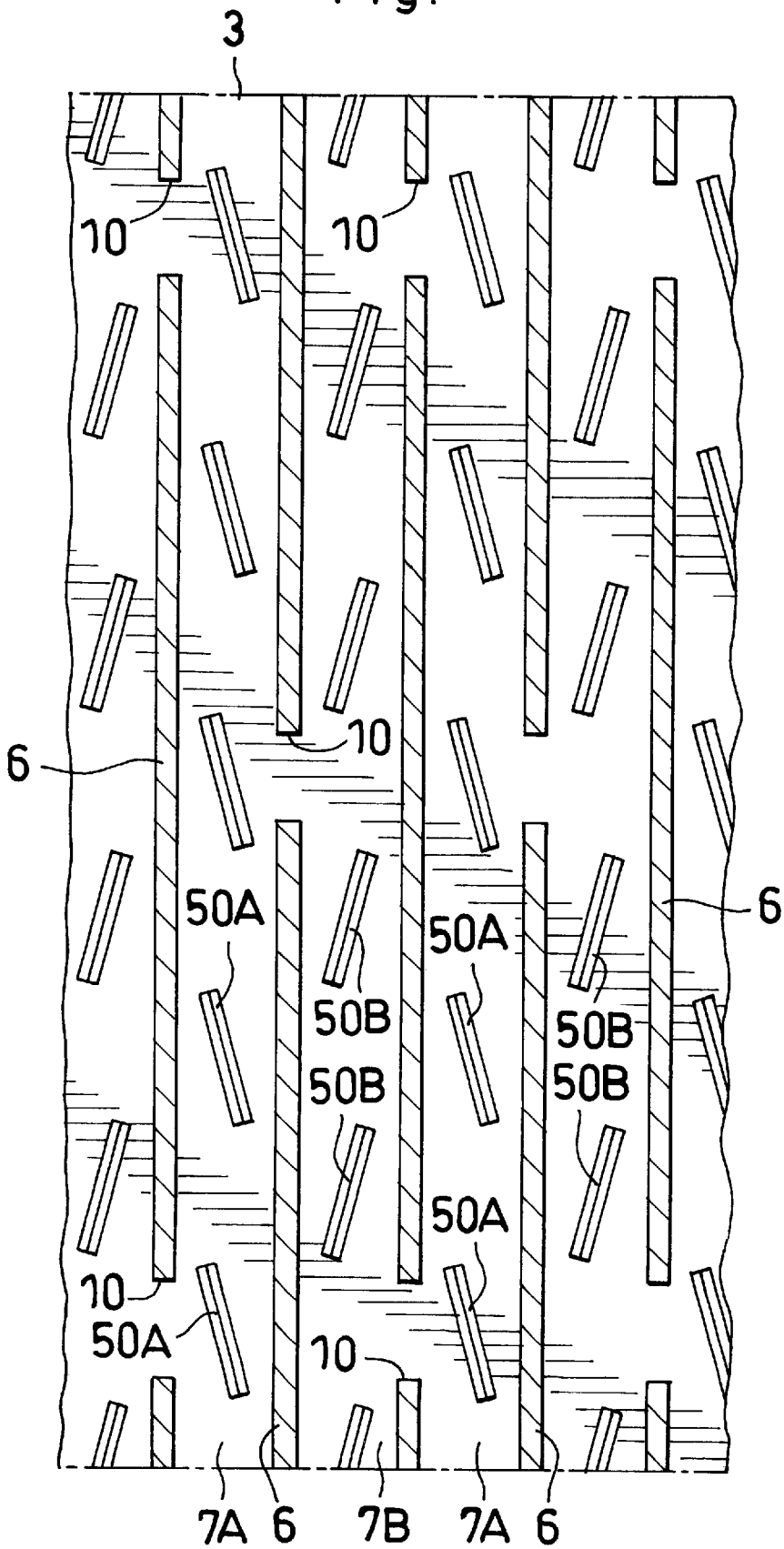
FIG. 11 is a view corresponding to FIG. 10 and showing modified turbulence producing portions according to the second embodiment.

FIG. 11 shows modified turbulence producing portions according to the second embodiment.

In this case, the upper surface of the lower wall 3 of the flat heat exchange tube is integrally provided with a plurality of turbulence producing portions 50A on the portion thereof forming one fluid passage 7A, the portions 50A extending straight as inclined rearwardly rightward, each having opposite ends separated from the two adjacent reinforcing walls 6 defining the passage therebetween, and being arranged at a spacing longitudinally thereof and each in the form of an upward projection. The lower wall upper surface is further integrally provided with a plurality of turbulence producing portions 50B on the portion thereof forming a fluid passage 7B adjacent to the passage 7A. The portions 50B extend straight as inclined rearwardly leftward, each have opposite ends separated from the two adjacent reinforcing walls 6 defining the passage 7B therebetween, and are each in the form of an upward projection and arranged at a spacing longitudinally of the passage. All the turbulence producing portions 50A, 50B are in a staggered arrangement when seen from above. The forward or rearward length of all the turbulence producing portions 50A, 50B is approximately one-fourth of the corresponding length of the turbulence producing portions 46A, 46B shown in FIG. 10. All of these portions 50A, 50B have a triangular cross section with an upwardly pointed apex.

Although not shown, the lower surface of the upper wall 2 of the flat heat exchange tube is integrally provided with a plurality of turbulence producing portions on the portion thereof forming each fluid passage 7A (7B). These portions extend straight as inclined rearwardly leftward or rightward, each have opposite ends separated from the two adjacent reinforcing walls 6 defining the passage therebetween, and are arranged at a spacing longitudinally thereof and each in the form of a downward projection. The turbulence producing portions formed on the upper wall lower surface forming the fluid passage 7A (7B) are arranged respectively in the same positions as the turbulence producing portions 50A (50B) formed on the lower wall upper surface in the same passage 7A (7B) with respect to the longitudinal direction but are inclined in the opposite direction to the portions 50A (50B) as they extend rearward.

Figure 12:
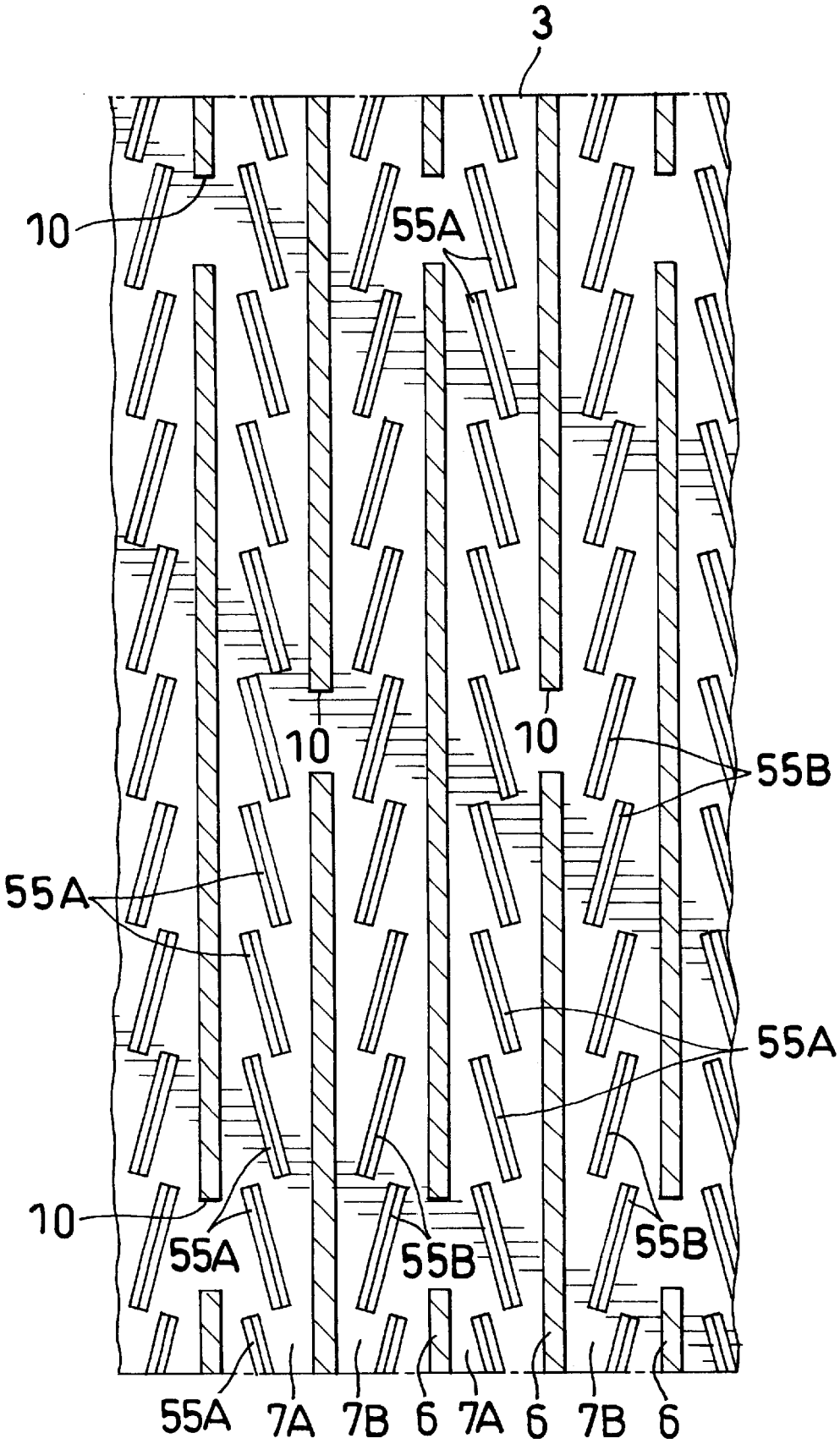
FIG. 12 is a view corresponding to FIG. 10 and showing other modified turbulence producing portions according to the second embodiment.

FIG. 12 shows other modified turbulence producing portions according to the second embodiment.

In this case, the upper surface of the lower wall 3 of the flat heat exchange tube is integrally provided with a plurality of turbulence producing portions 55A on the portion thereof forming one fluid passage 7A, the portions 55A extending straight as inclined rearwardly rightward, each having opposite ends separated from the two adjacent reinforcing walls 6 defining the passage therebetween, and being arranged at a spacing longitudinally thereof and each in the form of an upward projection. The lower wall upper surface is further integrally provided with a plurality of turbulence producing portions 55B on the portion thereof forming a fluid passage 7B adjacent to the passage 7A. The portions 55B extend straight as inclined rearwardly leftward, each have opposite ends separated from the two adjacent reinforcing walls 6 defining the passage 7B therebetween, and are each in the form of an upward projection and arranged at a spacing longitudinally of the passage. The turbulence producing portions 55A formed in the fluid passage 7A are arranged respectively in the same positions as the turbulence producing portions 55B provided in the fluid passage 7B adjacent to the passage 7A, with respect to the longitudinal direction. The forward or rearward length of all the turbulence producing portions 55A, 55B is equal to the corresponding length of the turbulence producing portions 50A, 50B shown in FIG. 11. The longitudinal spacing between all the turbulence producing portions 55A, 55B is smaller than the longitudinal spacing between the turbulence producing portions 50A, 50B shown in FIG. 11. All of these portions 50A, 50B have a triangular cross section with an upwardly pointed apex.

Although not shown, the lower surface of the upper wall 2 of the flat heat exchange tube is integrally provided with a plurality of turbulence producing portions on the portion thereof forming each fluid passage 7A (7B). These portions extend straight as inclined rearwardly leftward or rightward, each have opposite ends separated from the two adjacent reinforcing walls 6 defining the passage therebetween, and are arranged at a spacing longitudinally thereof and each in the form of a downward projection. The turbulence producing portions formed on the upper wall lower surface forming the fluid passage 7A (7B) are arranged respectively in the same positions as the turbulence producing portions 55A (55B) formed on the lower wall upper surface in the same passage 7A (7B) with respect to the longitudinal direction but are inclined in the opposite direction to the portions 55A (55B) as they extend rearward.

Figure 13:
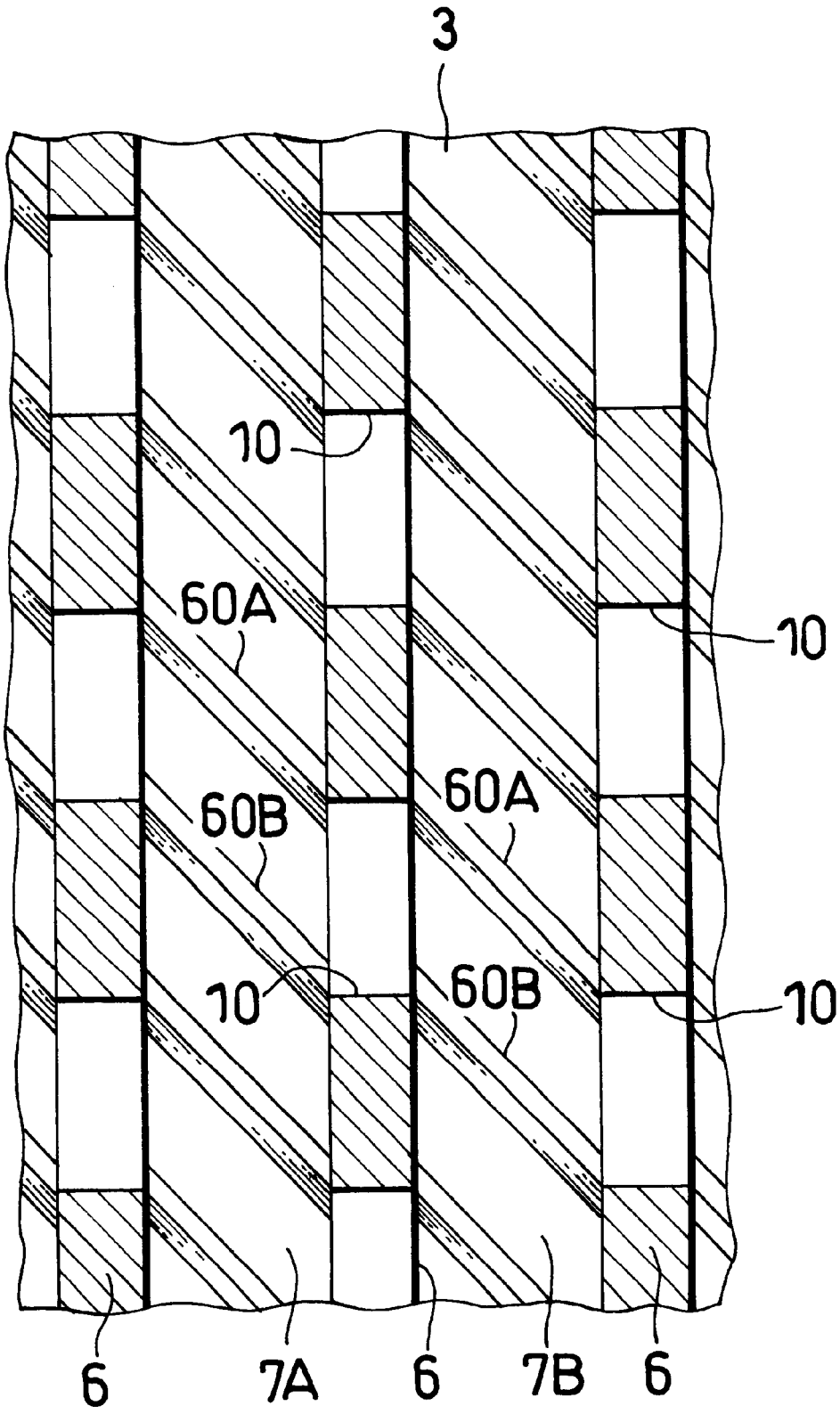
FIG. 13 is a view corresponding to FIG. 10 and showing other modified turbulence producing portions according to the second embodiment.
Figure 14:
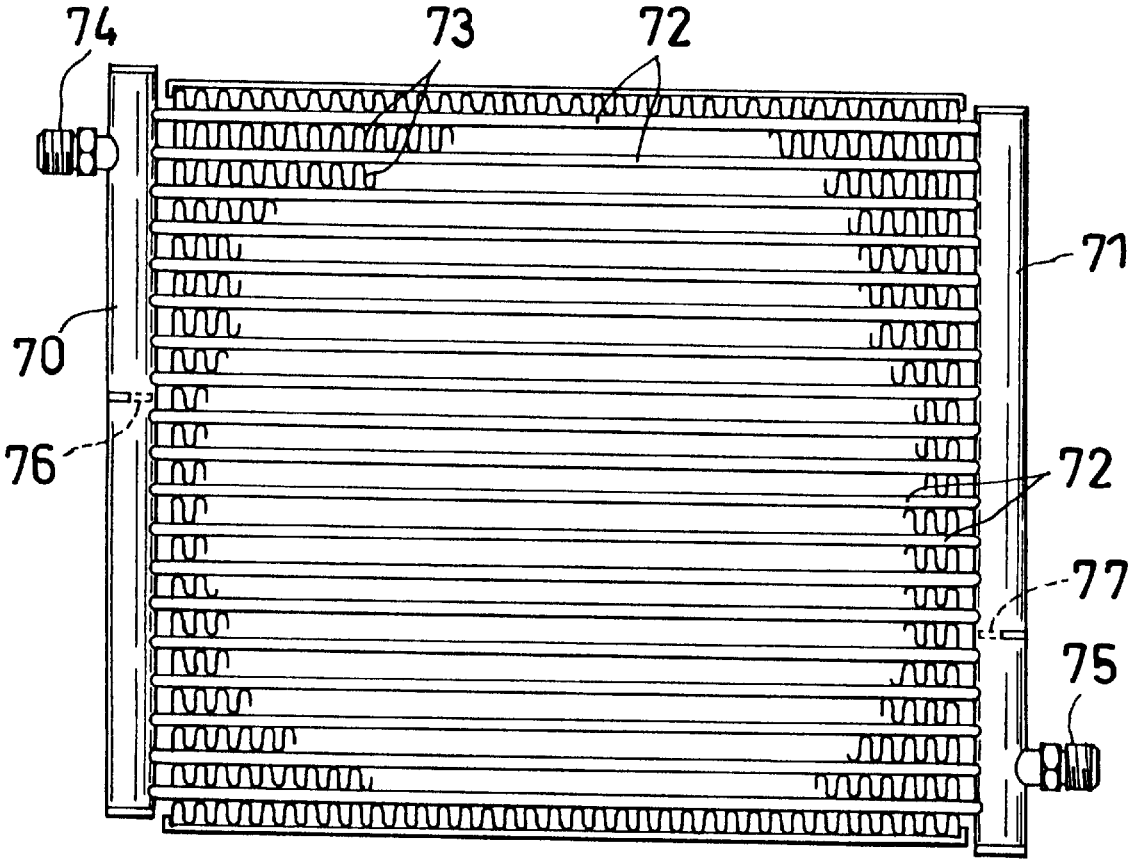
FIG. 14 is a side elevation showing an example of condenser for use in car air conditioners.

FIG. 13 shows other modified turbulence producing portions according to the second embodiment.

In this case, the upper surface of the lower wall 3 of the flat heat exchange tube is integrally provided with a plurality of turbulence producing portions 60A, 60B on the portion thereof forming each of fluid passages 7A, 7B. The portions 60A, 60B extend straight over the entire width of the fluid passage 7A or 7B as inclined rearwardly rightward, and are arranged at a spacing longitudinally of the passage and each in the form of an upward projection. Stated more specifically, each of the fluid passages 7A, 7B, is provided with turbulence producing portions 60A, 60B which are arranged alternately. The portions 60A each have a front end positioned in corresponding relation with the front end of the communication hole 10 formed in the left reinforcing wall 6 and a rear end positioned in corresponding relation with the front end of the communication hole 10 formed in the right reinforcing wall 6 and positioned immediately to the rear of the hole 10 in the left reinforcing wall 6. The turbulence producing portions 60B each have a front end positioned in corresponding relation with the rear end of the communication hole 10 formed in the left reinforcing wall 6 and a rear end positioned in corresponding relation with the rear end of the communication hole 10 formed in the right reinforcing wall 6 and positioned immediately to the rear of the hole 10 in the left reinforcing wall 6. The turbulence producing portions 60A, 60B have a triangular cross section with an upwardly pointed apex.

Although not shown, the lower surface of the upper wall 2 of the flat heat exchange tube is integrally provided with a plurality of turbulence producing portions on the portion thereof forming each fluid passage 7A (7B). These portions extend straight as inclined rearwardly leftward, each have opposite ends joined to the two adjacent reinforcing walls 6 defining the passage therebetween, and are arranged at a spacing longitudinally thereof and each in the form of a downward projection. The turbulence producing portions provided on the upper wall lower surface forming the fluid passage 7A (7B) are arranged respectively in the same positions as the turbulence producing portions 60A, 60B formed on the lower wall upper surface in the same passage 7A (7B) with respect to the longitudinal direction but are inclined in the opposite direction to the portions 60A, 60B as they extend rearward.

What is claimed is:

1. A flat heat exchange tube comprising an upper wall, a lower wall, right and left side walls interconnecting right and left side edges of the upper and lower walls, and a plurality of reinforcing walls connected between the upper and lower walls, extending longitudinally of the tube and spaced apart from one another, the tube having parallel fluid passages formed inside thereof and extending forward or rearward, each of the reinforcing walls having a plurality of communication holes longitudinally spaced along the passage for holding the parallel fluid passages in communication with one another therethrough, an upper surface of the lower wall being provided at a portion thereof forming each of the fluid passages with a plurality of turbulence producing portions extending over the entire width of the fluid passage and longitudinally spaced along the passage;

wherein the communication holes in the reinforcing walls are in a staggered arrangement when seen from above, and the turbulence producing portions include those each having one end positioned in corresponding relation with a front end of the communication hole formed in one of the adjacent reinforcing walls and the other end positioned in corresponding relation with a rear end of the communication hole formed in the other reinforcing wall and positioned immediately to the front of the communication hole in said one reinforcing wall, and those each having one end positioned in corresponding relation with a rear end of the communication hole formed in said one reinforcing wall and the other end positioned in corresponding relation with a front end of the communication hole formed in said other reinforcing wall and positioned immediately to the rear of the communication hole in said one reinforcing wall.

2. A flat heat exchange tube according to claim 1, wherein the turbulence producing portions extend straight transversely of the tube.

3. A flat heat exchange tube according to claim 1, wherein the turbulence producing portions are each V-shaped and have a lengthwise midportion projecting forward or rearward.

4. A flat heat exchange tube comprising an upper wall, a lower wall, right and left side walls interconnecting right and left side edges of the upper and lower walls, and a plurality of reinforcing walls connected between the upper and lower walls, extending longitudinally of the tube and spaced apart from one another, the tube having parallel fluid passages formed inside thereof and extending forward or rearward, each of the reinforcing walls having a plurality of communication holes longitudinally spaced along the passage for holding the parallel fluid passages in communication with one another therethrough, an upper surface of the lower wall being provided at a portion thereof forming each of the fluid passages with a plurality of turbulence producing portions extending over the entire width of the fluid passage and longitudinally spaced along the passage;

wherein the communication holes in the reinforcing walls are in a staggered arrangement when seen from above, and the turbulence producing portions include those each having one end positioned in corresponding relation with a front end of the communication hole formed in one of the adjacent reinforcing walls and the other end positioned in corresponding relation with a front end of the communication hole formed in the other reinforcing wall and positioned immediately to the rear of the communication hole in said one reinforcing wall, and those each having one end positioned in corresponding relation with a rear end of the communication hole formed in said one reinforcing wall and the other end positioned in corresponding relation with a rear end of the communication hole formed in said other reinforcing wall and positioned immediately to the rear of the communication hole in said one reinforcing wall.

5. A flat heat exchange tube according to claim 4 wherein the turbulence producing portions are each in the form of a crank.

6. A flat heat exchange tube according to claim 1 wherein a lower surface of the upper wall is provided at a portion thereof forming each of the fluid passages with a plurality of turbulence producing portions extending over the entire width of the fluid passage and arranged at a spacing longitudinally of the passage.

7. A flat heat exchange tube according to claim 6 wherein when seen from above, the turbulence producing portions on the lower surface of the upper wall have the same shape as the turbulence producing portions on the upper surface of the lower wall.

8. A flat heat exchange tube according to claim 4 wherein a lower surface of the upper wall is provided at a portion thereof forming each of the fluid passages with a plurality of turbulence producing portions extending over the entire width of the fluid passage and arranged at a spacing longitudinally of the passage.

9. A flat heat exchange tube according to claim 8 wherein when seen from above, the turbulence producing portions on the lower surface of the upper wall have the same shape as the turbulence producing portions on the upper surface of the lower wall.

10. A flat heat exchange tube comprising an upper wall, a lower wall, right and left side walls interconnecting right and left side edges of the upper and lower walls, and a plurality of reinforcing walls connected between the upper and lower walls, extending longitudinally of the tube and spaced apart from one another, the tube having parallel fluid passages formed inside thereof, an upper surface of the lower wall being provided at a portion thereof forming each of the fluid passages with a plurality of straight turbulence producing portions inclined leftward or rightward and longitudinally spaced along the tube;

wherein the turbulence producing portions each have opposite ends joined respectively to the adjacent reinforcing walls defining the fluid passage.

11. A flat heat exchange tube according to claim 10 wherein the turbulence producing portions in all the fluid passages are inclined in the same direction.

12. A flat heat exchange tube according to claim 10 wherein all the turbulence producing portions in one of the fluid passages are inclined in the same direction, and all the turbulence producing portions in the fluid passage adjacent to said one fluid passage are inclined in a direction opposite to said direction.

13. A flat heat exchange tube according to claim 10 wherein all the turbulence producing portions are in a staggered arrangement when seen from above.

* * * * *